US011370095B2

(12) United States Patent
Chien

(10) Patent No.: US 11,370,095 B2
(45) Date of Patent: Jun. 28, 2022

(54) FLYWHEEL DEVICE AND ELECTRIC NAIL GUN HAVING THE SAME

(71) Applicant: BASSO INDUSTRY CORP., Taichung (TW)

(72) Inventor: Chia-Yu Chien, Taichung (TW)

(73) Assignee: Basso Industry Corp., Taichung (TW)

( * ) Notice: Subject to any disclaimer, the term of this patent is extended or adjusted under 35 U.S.C. 154(b) by 214 days.

(21) Appl. No.: 16/751,815

(22) Filed: Jan. 24, 2020

(65) Prior Publication Data

US 2020/0246951 A1 Aug. 6, 2020

(30) Foreign Application Priority Data

Jan. 31, 2019 (TW) ..... 108103712

(51) Int. Cl.
*B25C 1/06* (2006.01)

(52) U.S. Cl.
CPC ..... *B25C 1/06* (2013.01)

(58) Field of Classification Search
CPC ..... B25F 5/001; B25F 5/02; B25C 1/06
See application file for complete search history.

(56) References Cited

U.S. PATENT DOCUMENTS 5,014,793 A * 5/1991 Germanton ..... B25B 21/00 173/181
6,669,072 B2 * 12/2003 Burke ..... B25C 1/06 173/122
7,506,788 B2 * 3/2009 Liang ..... B25C 1/06 227/129
8,479,966 B2 * 7/2013 Chien ..... B25C 1/06 227/131
8,511,532 B2 * 8/2013 Chien ..... B25C 1/06 227/133
8,740,033 B2 * 6/2014 Li ..... B25C 1/008 227/133
9,457,462 B2 * 10/2016 Mergener ..... B27F 5/02
10,022,848 B2 7/2018 Gross et al.
(Continued)

FOREIGN PATENT DOCUMENTS

DE 102005000062 11/2006
DE 102005023683 11/2006
(Continued)

OTHER PUBLICATIONS

Office Action issued to United Kingdom counterpart application No. 2000978.3 by the UKIPO dated Jun. 26, 2020.

*Primary Examiner* — Nathaniel C Chukwurah
*Assistant Examiner* — Lucas E. A. Palmer
(74) *Attorney, Agent, or Firm* — Burris Law, PLLC

(57) ABSTRACT

A flywheel device is adapted to be installed in an electric nail gun. The electric nail gun includes a main frame, a drive pulley rotatably mounted to the main frame, and a transmission belt. The flywheel device includes a flywheel pulley adapted to be mounted to the main frame, a flywheel connected coaxially and co-rotatably to the flywheel pulley, and a weight disc connected coaxially and co-rotatably to the flywheel and the flywheel pulley. The transmission belt is trained on the drive pulley and the flywheel pulley. During co-rotation of the flywheel pulley, the flywheel and the weight disc, a swing arm is pivotable to move an impact member to contact the flywheel for actuating a nailing process of the electric nail gun.

8 Claims, 3 Drawing Sheets

(56) References Cited

U.S. PATENT DOCUMENTS

2005/0218178 A1* 10/2005 Berry ..... B25C 1/06 227/8
2006/0261125 A1* 11/2006 Schiestl ..... B25C 1/06 227/131
2008/0257933 A1* 10/2008 Takahashi ..... B25C 5/15 227/129
2009/0032567 A1* 2/2009 Liang ..... B25C 1/06 227/131
2010/0038397 A1* 2/2010 Krondorfer ..... B25C 1/06 227/8
2011/0094847 A1* 4/2011 Hirabayashi ..... B25C 1/06 192/105 R
2011/0259937 A1 10/2011 Chien et al.
2012/0067934 A1* 3/2012 Li ..... B25C 1/008 227/8
2012/0074195 A1* 3/2012 Chien ..... B25C 1/06 227/147
2013/0153254 A1* 6/2013 Liang ..... B25C 1/06 173/114
2013/0255447 A1* 10/2013 Po ..... B25B 21/00 81/57.11
2013/0255984 A1* 10/2013 Po ..... B25C 1/06 173/112
2015/0034345 A1* 2/2015 Po ..... B25C 1/06 173/46
2015/0251300 A1* 9/2015 Po ..... B25C 1/06 227/132
2016/0129578 A1* 5/2016 Sprenger ..... B25F 5/001 173/1
2017/0100828 A1* 4/2017 Chien ..... B25C 1/08
2018/0015600 A1* 1/2018 Akiba ..... B25C 1/008
2019/0366526 A1* 12/2019 Schmidt ..... B25F 5/00
2020/0238491 A1* 7/2020 Chien ..... B25C 1/008
2020/0246951 A1* 8/2020 Chien ..... B25C 1/06
2020/0246952 A1* 8/2020 Chien ..... B25C 1/06
2021/0122019 A1* 4/2021 Lai ..... B25C 1/06
2021/0237246 A1* 8/2021 Chien ..... B25F 5/008

FOREIGN PATENT DOCUMENTS

EP 1932624 A1 * 6/2008 ..... B25C 1/06
EP 1932624 A1 6/2008
GB 2239623 A 7/1991
JP 2006142392 A 6/2006
TW M482482 U 7/2014
WO 02051591 A1 7/2002
WO 2016015489 A1 2/2016
WO WO-2016015489 A1 * 2/2016 ..... B25F 5/00

* cited by examiner

FLYWHEEL DEVICE AND ELECTRIC NAIL GUN HAVING THE SAME

CROSS-REFERENCE TO RELATED APPLICATION

This application claims priority of Taiwanese Patent Application No. 108103712, filed on Jan. 31, 2019.

FIELD

The disclosure relates to a nail gun, and more particularly to a flywheel device and an electric nail gun having the flywheel device.

BACKGROUND

A conventional electric nail gun disclosed in Taiwanese Utility Model Patent No. M482482 U uses a flywheel, which builds up a potential energy to be released as a kinetic energy to move an impact member in high speed and to actuate a nailing process of the electric nail gun.

In order to increase the nailing speed and impact (i.e. the speed and impact of the impact member against a nail), the kinetic energy of the flywheel must be increased. In the case of the conventional electric nail gun, this goal is achieved by increasing the rotational speed of the flywheel. However, such means accelerates wear of the flywheel (i.e. shortens its lifespan), and increases power consumption; in other words, this leads to higher maintenance and electricity costs.

SUMMARY

Therefore, an object of the disclosure is to provide a flywheel device that can alleviate at least one of the drawbacks associated with the abovementioned prior art.

Accordingly, a flywheel device is adapted to be installed in an electric nail gun. The electric nail gun includes a main frame, a swing arm that is pivoted to the main frame, an impact member that is slidably mounted to the swing arm, a drive pulley that is rotatably mounted to the main frame, and a transmission belt that is trained on the drive pulley. The flywheel device includes a flywheel pulley, a flywheel and a weight disc.

The flywheel pulley is adapted to be mounted to the main frame and is trained by the transmission belt such that rotation of the drive pulley drives the flywheel pulley to rotate.

The flywheel is adapted to be mounted to the main frame and is connected coaxially and co-rotatably to the flywheel pulley.

The weight disc is adapted to be mounted to the main frame and is connected coaxially and co-rotatably to the flywheel and the flywheel pulley.

During the co-rotation of the flywheel pulley, the flywheel and the weight disc, the swing arm is pivotable relative to the main frame to move the impact member to contact the flywheel, so that the impact member is driven by the flywheel to slide relative to the swing arm for actuating a nailing process of the electric nail gun.

Another object of the disclosure is to provide a electric nail gun that includes the abovementioned flywheel device.

Accordingly, an electric nail gun includes a main frame, a swing arm, an impact member, a drive module, a drive pulley, a transmission belt, a flywheel pulley, a flywheel and a weight disc.

The swing arm is pivoted to the main frame. The impact member is slidably mounted to the swing arm. The drive module is mounted to the main frame. The drive pulley is mounted to the main frame, and is driven rotatably by the drive module.

The flywheel pulley is mounted to the main frame. The transmission belt is trained on the drive pulley and the flywheel pulley for transmitting rotational motion from the drive pulley to the flywheel pulley.

The flywheel is mounted to the main frame, and is connected coaxially and co-rotatably to the flywheel pulley.

The weight disc is mounted to the main frame and is connected coaxially and co-rotatably to the flywheel and the flywheel pulley.

During the co-rotation of the flywheel pulley, the flywheel and the weight disc, the swing arm is pivotable relative to the main frame to move the impact member to contact the flywheel, so that the impact member is driven by the flywheel to slide relative to the swing arm for actuating a nailing process of the electric nail gun.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
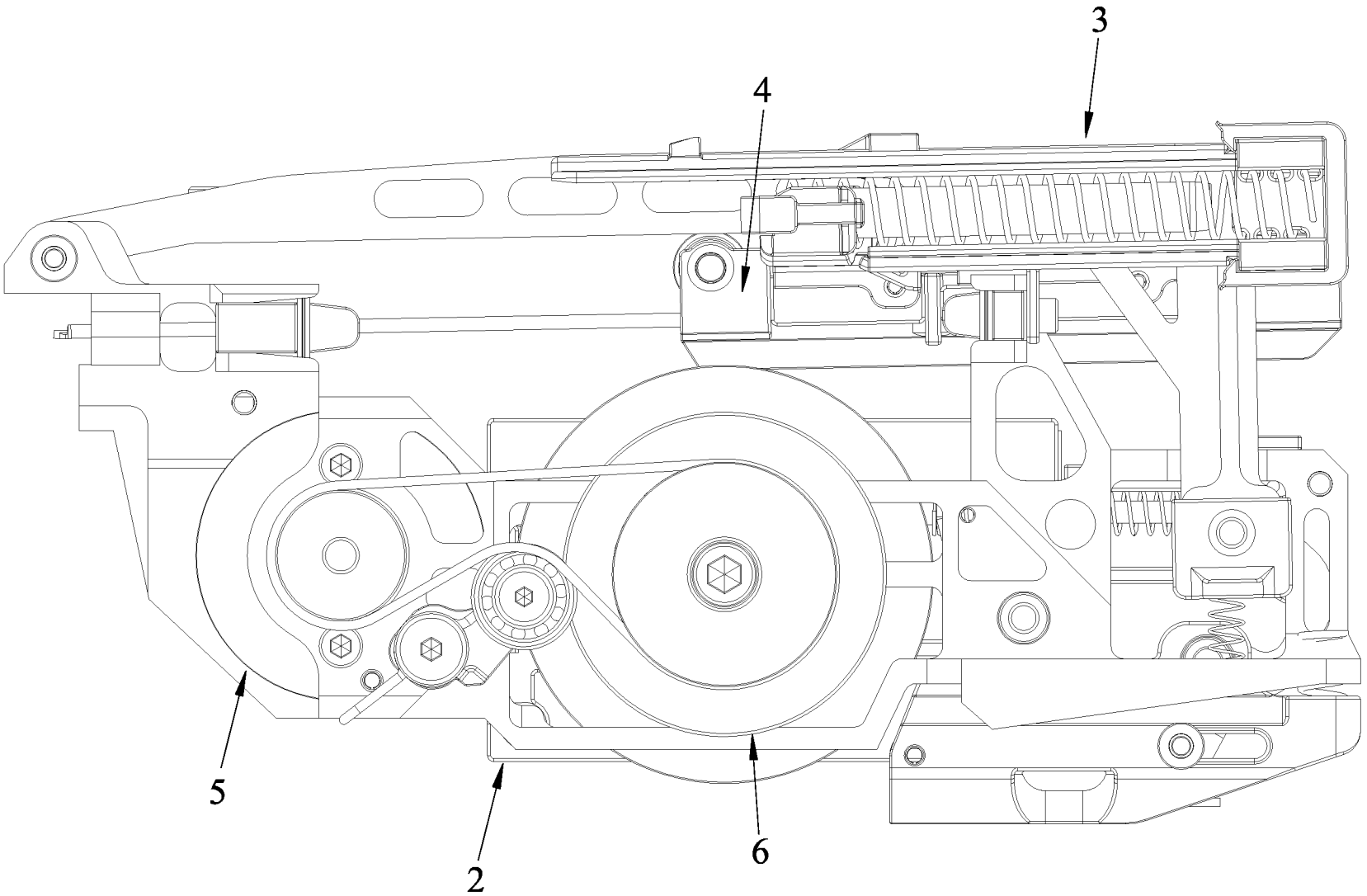
FIG. 1 is a side view of an embodiment of an electric nail gun according to the disclosure.
Figure 2:
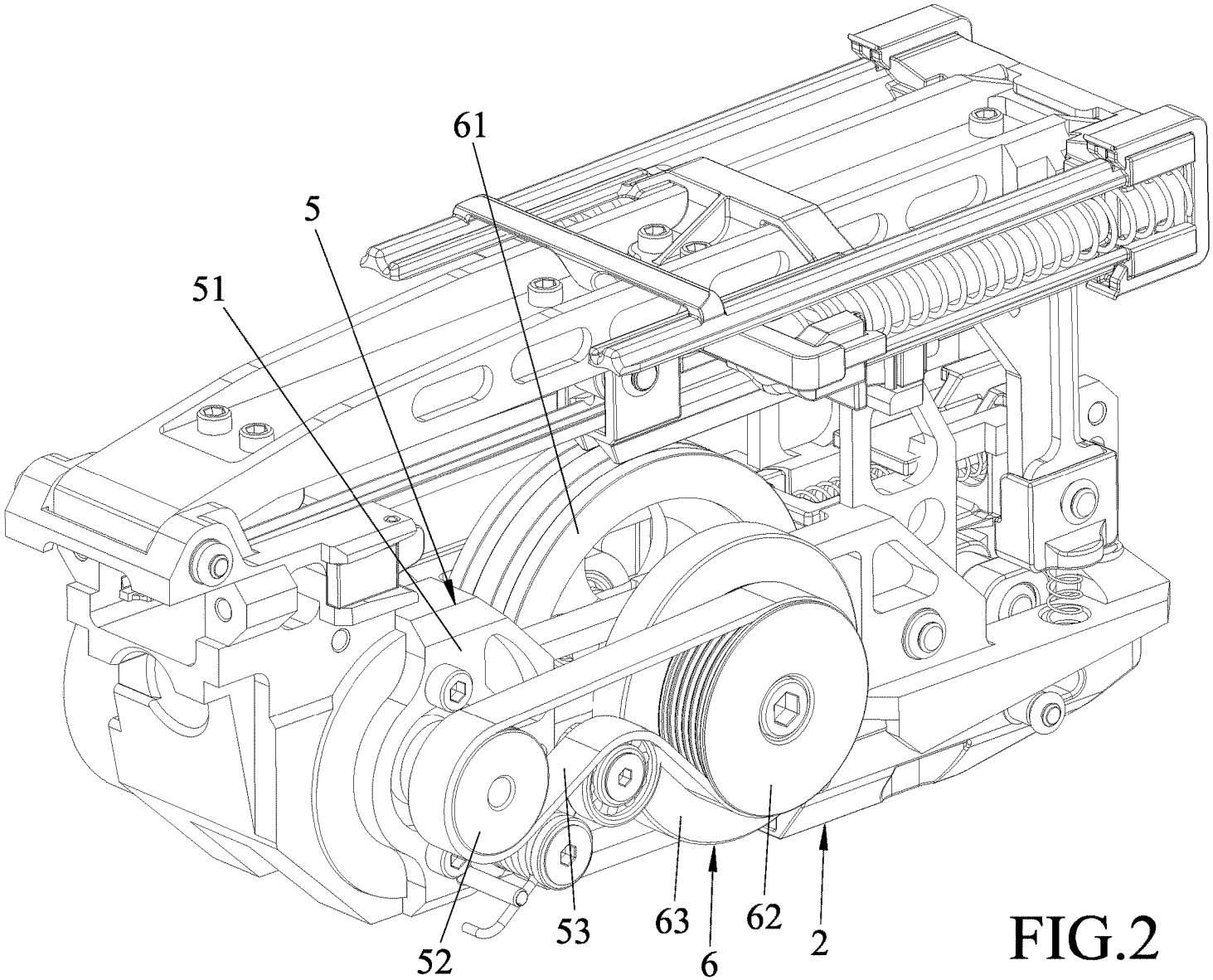
FIG. 2 is a perspective view of the embodiment.

Referring to FIGS. 1 and 2, an embodiment of an electric nail gun according to the disclosure includes a main frame 2, a swing arm 3, an impact member 4, a drive device 5 and a flywheel device 6.

The swing arm 3 is pivoted to the main frame 2. The impact member 4 is slidably mounted to the swing arm 3. The drive device 5 includes a drive module 51 and a drive pulley 52.

The drive module 51 and the drive pulley 52 are mounted to the main frame 2. The drive pulley 52 is driven rotatably by the drive module 51. In the present embodiment, the drive module 51 includes a motor.

The flywheel device 6 includes a flywheel pulley 62, a flywheel 61 and a weight disc 63.

The flywheel pulley 62 is mounted to the main frame 2. The drive device 5 further includes a transmission belt 53 trained on the drive pulley 52 and the flywheel pulley 62 such that rotational motion is transmitted from the drive pulley 52 to the flywheel pulley 62, that is, the rotation of the drive pulley 52 drives rotation of the flywheel pulley 62. The flywheel 61 is mounted to the main frame 2, and is connected coaxially and co-rotatably to the flywheel pulley 62.

The weight disc 63 is mounted to the main frame 2 and is connected coaxially and co-rotatably to the flywheel 61 and the flywheel pulley 62. It should be noted that, in the present embodiment, a diameter of the weight disc 63 is larger than a diameter of the flywheel pulley 62; the weight disc 63 and the flywheel pulley 62 are molded as one piece; and the weight disc 63 is connected between the flywheel 61 and the flywheel pulley 62.

During the co-rotation of the flywheel pulley 62, the flywheel 61 and the weight disc 63, the swing arm 3 is pivotable relative to the main frame 2 to move the impact member 4 to be in contact with the flywheel 61, so that the impact member 4 is driven by the flywheel 61 to slide relative to the swing arm 3 for actuating a nailing process of the electric nail gun.

Further details of the nailing process which involves the swing arm 3, the impact member 4, the driving device 5, the flywheel 61 and the flywheel pulley 62 have been disclosed in Taiwanese Utility Model Patent No. M482482 U and hence will not be described hereinafter.

It should be noted that, by including the weight disc 63 in the flywheel device 6, a moment of inertia of the flywheel device 6 is increased, which in turn increases the kinetic energy of the flywheel device 6 without having to increase a rotational speed of the flywheel device 6.

Figure 3:
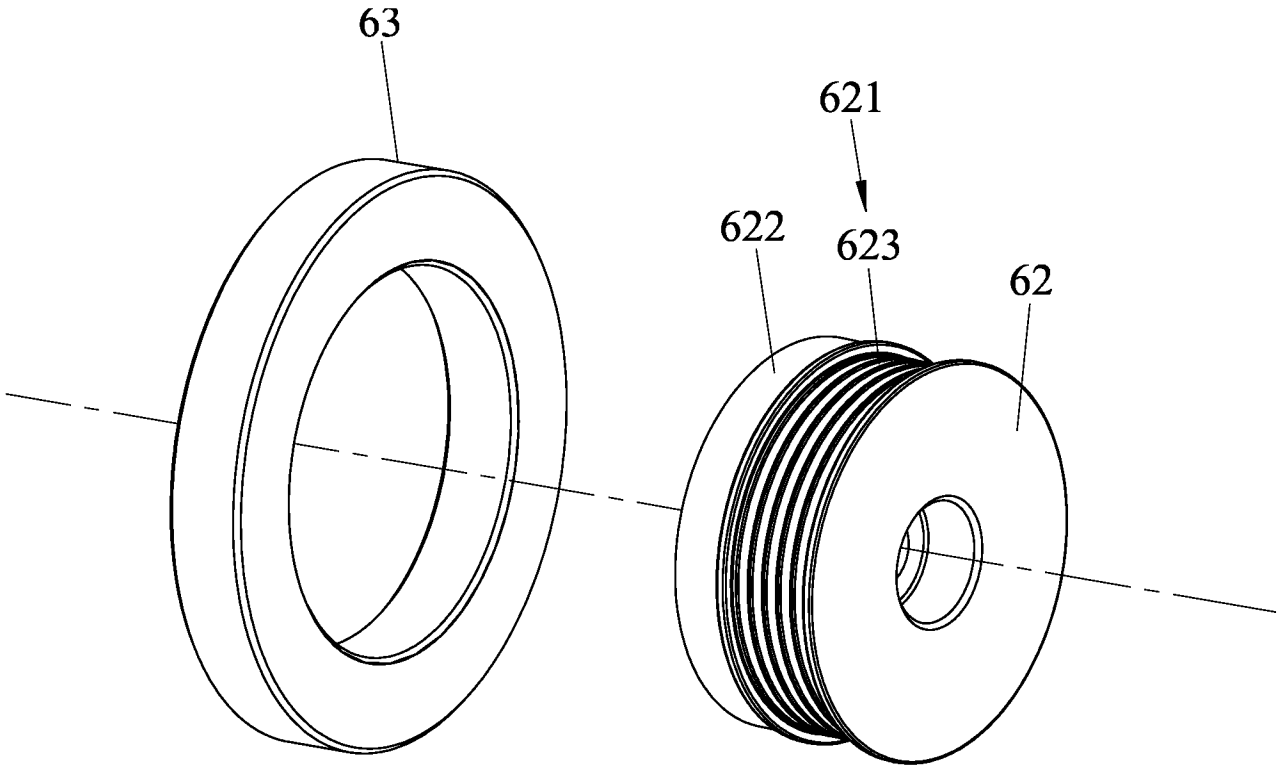
FIG. 3 is an exploded perspective view, illustrating a flywheel pulley and a weight disc in a variation of the embodiment.

Referring to FIG. 3, a variation of the embodiment is shown. In this variation, the flywheel pulley 62 and the weight disc 63 are separable components.

Specifically, the flywheel pulley 62 has a grooved portion 621 and an insert portion 622. The grooved portion 621 is formed with a belt groove 623 that is engaged with the transmission belt 53 of the drive device 5. The insert portion 622 is disposed adjacent to the belt groove 623, and the weight disc 63 is removably sleeved on the insert portion 622.

In sum, the electric nail gun according to the disclosure has advantages as follows.

Firstly, by virtue of the inclusion of the weight disc 63, the moment of inertia of the flywheel device 6 is increased, and the kinetic energy of the flywheel device 6 is in turn increased without the need to increase its rotational speed. Furthermore, since the moment of inertia of the weight disc 63 is correlated with both its weight and diameter, it is not necessary to employ a particularly heavy weight disc 63; simply by increasing the diameter of the weight disc 63, the movement of inertia thereof is increased. Thus, the electric nail gun of the disclosure does not accelerate wear of the flywheel device 6 as the prior art does.

Secondly, without the need to adjust configurations of the flywheel 61 and other components of the electric nail gun in order to increase the kinetic energy of the flywheel device 6, an overall manufacturing cost is lowered.

Finally, since the flywheel pulley 62 and the weight disc 63 can be either molded as one piece or configured as separate components, the electric nail gun of the present disclosure is rather flexible to meet different nailing requirements.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A flywheel device adapted to be installed in an electric nail gun, the electric nail gun including a main frame, a swing arm that is pivoted to the main frame, an impact member that is slidably mounted to the swing arm, a drive pulley that is rotatably mounted to the main frame, and a transmission belt that is trained on the drive pulley, said flywheel device comprising:

a flywheel pulley adapted to be mounted to the main frame and trained by the transmission belt such that rotation of the drive pulley drives said flywheel pulley to rotate; and a flywheel adapted to be mounted to the main frame and connected coaxially and co-rotatably to said flywheel pulley; and a weight disc adapted to be mounted to the main frame and connected coaxially and co-rotatably to said flywheel and said flywheel pulley;

wherein during the co-rotation of said flywheel pulley, said flywheel and said weight disc, the swing arm is pivotable relative to the main frame to move the impact member to contact said flywheel so that the impact member is driven by said flywheel to slide relative to the swing arm for actuating a nailing process of the electric nail gun; and wherein a diameter of said weight disc is larger than a diameter of said flywheel pulley, and said weight disc has an annular shape and is sleeved on said flywheel pulley.

2. The flywheel device as claimed in claim 1, wherein said flywheel pulley and said weight disc are molded as one piece.

3. The flywheel device as claimed in claim 1, wherein said flywheel pulley has:

a grooved portion formed with a belt groove that is adapted to be engaged with the transmission belt; and a insert portion disposed adjacent to said belt groove, said weight disc being sleeved on said insert portion.

4. The flywheel device as claimed in claim 1, wherein said weight disc is connected between said flywheel and said flywheel pulley.

5. An electric nail gun comprising:

a main frame;

a swing arm pivoted to said main frame;

an impact member slidably mounted to said swing arm;

a drive module mounted to said main frame;

a drive pulley mounted to the main frame, and driven rotatably by said drive module;

a transmission belt;

a flywheel pulley mounted to said main frame, said transmission belt being trained on said drive pulley and said flywheel pulley for transmitting rotational motion from said drive pulley to said flywheel pulley;

a flywheel mounted to said main frame, and connected coaxially and co-rotatably to said flywheel pulley; and a weight disc mounted to said main frame and connected coaxially and co-rotatably to said flywheel and said flywheel pulley;

wherein during the co-rotation of said flywheel pulley, said flywheel and said weight disc, said swing arm is pivotable relative to said main frame to move said impact member to contact said flywheel so that said impact member is driven by said flywheel to slide relative to said swing arm for actuating a nailing process of said electric nail gun; and wherein a diameter of said weight disc is larger than a diameter of said flywheel pulley, and said weight disc has an annular shape and is sleeved on said flywheel pulley.

6. The electric nail gun as claimed in claim 5, wherein said flywheel pulley and said weight disc are molded as one piece.

7. The electric nail gun as claimed in claim 5, wherein said flywheel pulley has:

a grooved portion formed with a belt groove that is engaged with said transmission belt; and a insert portion disposed adjacent to said belt groove, said weight disc being sleeved on said insert portion.

8. The electric nail gun as claimed in claim 5, wherein said weight disc is connected between said flywheel and said flywheel pulley.

* * * * *